United States Patent [19]

Ellingson, Jr.

[11] 4,078,773

[45] Mar. 14, 1978

[54] HAND RAIL AND WALL BUMPER STRUCTURE

[76] Inventor: Chester W. Ellingson, Jr., 13909 Frontier La., Burnsville, Minn. 55337

[21] Appl. No.: 771,203

[22] Filed: Feb. 23, 1977

[51] Int. Cl.[2] ..... E04H 17/14

[52] U.S. Cl. ..... 256/65; 248/251; 52/716

[58] Field of Search ..... 256/59, 65, 24; 248/251, 345.1; 52/716, 717, 287

[56] References Cited

U.S. PATENT DOCUMENTS

| | | | |
|---|---|---|---|
| 3,071,350 | 1/1963 | Opie | 256/65 |
| 3,182,963 | 5/1965 | Thom | 256/65 |
| 3,227,477 | 1/1966 | Theisen | 256/65 X |
| 3,667,177 | 6/1972 | Biela | 52/287 X |
| 3,825,229 | 7/1974 | Bartlett | 256/59 |
| 3,842,564 | 10/1974 | Brown | 248/251 X |

FOREIGN PATENT DOCUMENTS

| | | | |
|---|---|---|---|
| 235,455 | 12/1961 | Australia | 52/717 |
| 1,156,455 | 12/1957 | France | 256/65 |
| 1,913,316 | 9/1970 | Germany | 256/59 |
| 2,332,618 | 1/1975 | Germany | 256/59 |

*Primary Examiner*—Andrew V. Kundrat
*Attorney, Agent, or Firm*—Leo Gregory

[57] ABSTRACT

This invention relates to a new combination of a wall supported hand rail having as a part thereof and depending therefrom a plate member forming a bumper to protect the adjacent wall surface from being marred or otherwise damaged by engagement of manually moved vehicles such as laundry carts or food tray cabinets as in a hospital corridor.

2 Claims, 4 Drawing Figures

FIG. 1
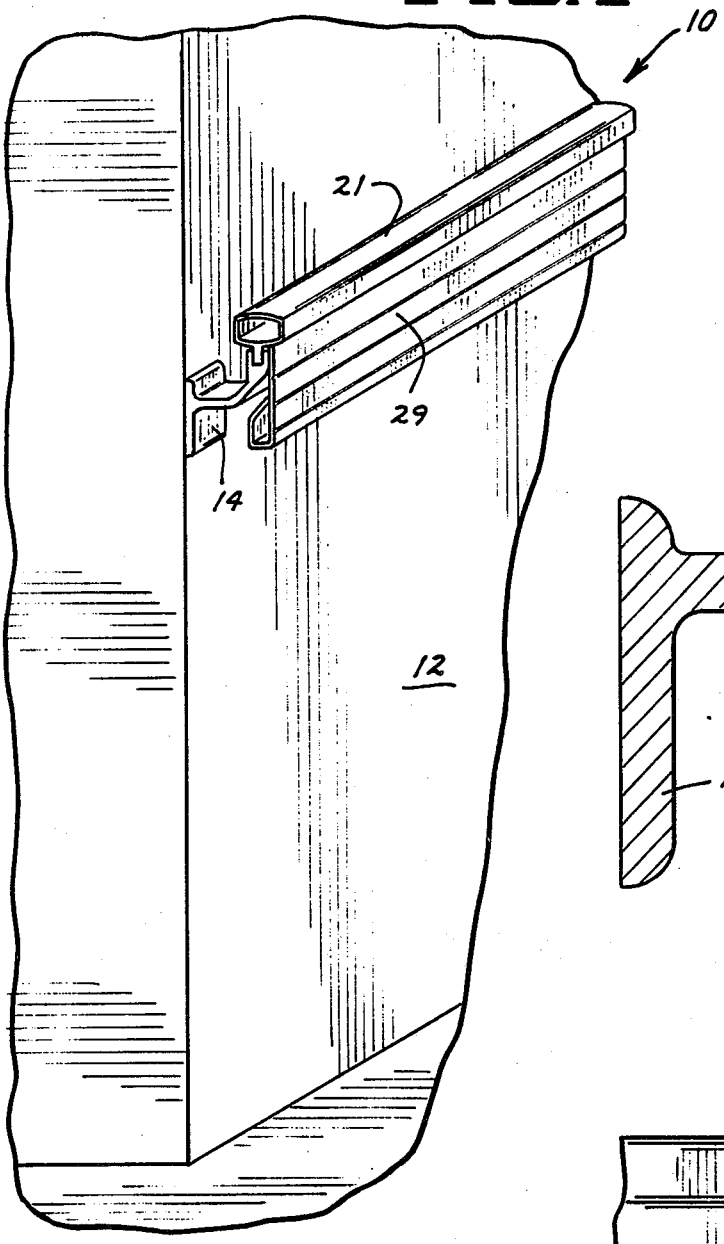
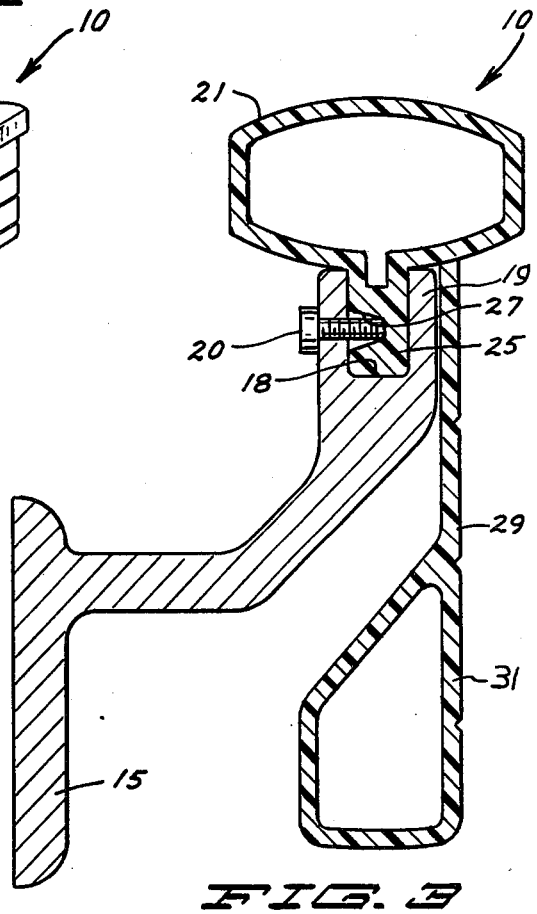
FIG. 3
FIG. 2
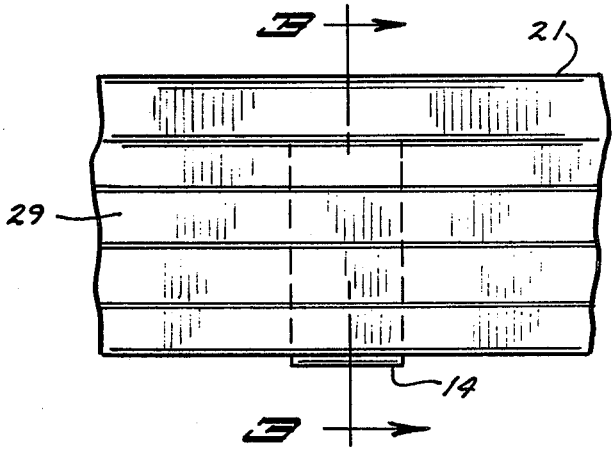
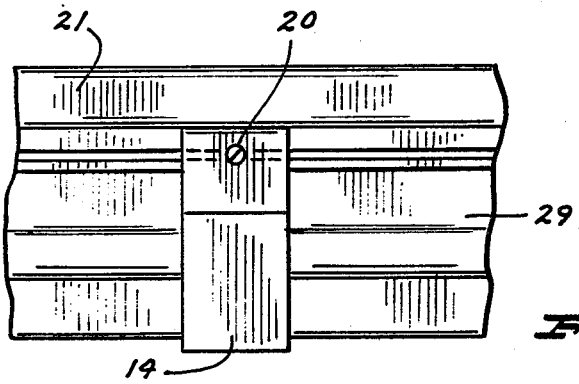
FIG. 4

HAND RAIL AND WALL BUMPER STRUCTURE

BACKGROUND AND SUMMARY OF THE INVENTION

Wall damage occurs frequently in corridors such as in hospitals or nursing homes wherein there is a great deal of movement of vehicles such as of laundry carts, cabinets carrying food trays, beds, wheel chairs and the like. Wall damage is unsightly and relatively expensive to repair. The corridors as a general practice are equipped with hand rails and with various types of protective coverings, strips, or pads applied to wall surfaces.

It is desirable to have a combination of a hand rail and a bumper as a unitary installation for wall protection.

It is an object of this invention to provide a hand rail in combination with a wall bumper as a unitary structure.

It is another object of this invention to provide a wall bracket adapted to have removably mounted thereon a combination structure comrpising a hand rail and a wall protective device.

It is more specifically an object of this invention to provide in connection with a wall bracket as in a corridor, a hand rail having a depending rib seated in an accommodating slot in said bracket, means removably securing said hand rail, and a plate member depending from said hand rail a sufficient distance and having sufficient rigidity to protect an adjacent wall surface from becoming marred or otherwise damaged by warding of a moving vehicle such as a wheeled cart.

These and other object and advantages of the invention will be set forth in the following description made in connection with the accompanying drawings in which like reference characters refer to similar parts throughout the several views and in which:

FIG. 1 is a fragmentary view in perspective and partially in section of the structure herein;

FIG. 2 is a fragmentary view in front elevation showing a portion in dotted line;

FIG 3 is a view in vertical section on an enlarged scale taken on line 3—3 of FIG. 2 as indicated; and FIG. 4 is a view similar to FIG. 2 in rear elevation.

DESCRIPTION OF A PREFERRED EMBODIMENT

Referring to the drawings, a wall 12 is indicated having mounted thereon a wall bracket 14 carrying a structure 10 comprising a hand rail having depending therefrom a protective plate member or wall bumper.

Said bracket 14 will be formed of a suitable metal material and is shown having a base portion 15 applied to a wall surface to be secured thereto as by the use of an adhesive or by the use of screws, not here shown. Said bracket has an upwardly facing open ended slot 18 therein. Said bracket will be mounted at suitable intervals along a wall surface as in a corridor.

The combination hand rail and wall protective plate member 10 carried by the said bracket 14 comprises hand rail 21 tubular in cross-section as illustrated and depending centrally longitudinally thereof is a rib 25 having a cross-sectional dimension to fit snugly into said open ended slot 18.

Said rib as here shown has a horizontal open ended tapered slot 27 extending inwardly of the inner side wall thereof as illustrated. A set screw 20 is threaded through the wallfacing side of said bracket portion 17 extending into said slot 27 and removably securing said rib 25.

Depending from a forward underlying portion of said hand rail 21 and extending therealong is plate member or bumper 29 which is positioned to overlie with its upper portion the adjacent outer facing wall portion 19 of said bracket portion 17 and forms a wall protective member.

Said wall portion 29 is formed as here shown to have its lower portion tubular in cross-section for the purpose of adding strength and rigidity to said lower portion of said plate member with the use of a minimum of material. It will be noted that there is also a considerable savings of material in forming hand rail 21 as a tubular structure. The entire structure 10 is formed of an extruded polyvinyl chloride to form an overall substantially rigid structure. Further, the upper portion of the wall 29 in bearing against the adjacent surface 19 of the bracket 14 is thus given with rigid support.

It will be understood that said member 10 may be formed of attractive colored material as may be desired.

The bracket 14 and the hand rail 21 supported thereby are at a height for convenient hand holding. The plate member 29 extends downwardly sufficiently for engagement by the upper portions of moving vehicles, such as laundry carts or food tray cabinets and thus said depending wall portion 29 provides protection to the underlying wall such as a wall 12 in FIG. 21.

The structure as described is very readily installed, it provides excellent wall protection and has been very successful in operation.

It will of course be understood that various changes may be in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A hand holding and wall protective structure comprising a wall secured bracket an elongated hand holding rail member, means removably securing said rail member to said bracket, a wall protective member integral with said rail member and depending therefrom, said bracket having an upwardly angled portion having an open ended slot therein, a rib depending from said rail member seated with said slot, means removably securing said rib within said slot, said rib having an open ended inwardly extending slot at one side thereof, and a securing member extending through said upwardly angled portion of said bracket into said slot.

2. The structure set forth in claim 1, wherein said securing member comprises a set screw.

* * * * *